United States Patent [19]

Meldrum

[11] Patent Number: 4,509,667

[45] Date of Patent: Apr. 9, 1985

[54] WRIST OR ARMBAND FOR HOLDING CAMERA

[76] Inventor: Kent J. Meldrum, 4820 E. Clearwater Pkwy., Paradise Valley, Ariz. 85253

[21] Appl. No.: 572,817

[22] Filed: Jan. 23, 1984

[51] Int. Cl.[3] ..... A45C 11/00

[52] U.S. Cl. ..... 224/250; 224/222; 224/901; 224/907

[58] Field of Search ..... 224/191, 219, 222, 224, 224/242, 250, 255, 267, 901, 907, 908

[56] References Cited

U.S. PATENT DOCUMENTS

| | | | |
|---|---|---|---|
| 2,187,449 | 1/1940 | French | 95/48 |
| 2,771,014 | 11/1956 | Tolcher | 95/86 |
| 3,938,166 | 2/1976 | Sloop | 354/82 |
| 3,966,101 | 6/1976 | Taylor | 224/28 |
| 4,096,863 | 6/1978 | Kaplan et al. | 128/349 |
| 4,103,808 | 8/1978 | Hallman | 224/4 D |
| 4,135,653 | 1/1979 | Sieloff | 224/222 |
| 4,136,805 | 1/1979 | Storms | 224/247 X |
| 4,341,331 | 7/1982 | McDougall | 224/219 |
| 4,432,477 | 2/1984 | Haidt et al. | 224/222 |

*Primary Examiner*—Stephen Marcus
*Assistant Examiner*—David Voorhees
*Attorney, Agent, or Firm*—Warren F. B. Lindsley

[57] ABSTRACT

A camera support for mounting on the arm of a user for carrying and positioning a camera for use even during periods of physical activity. The support comprises a waterproof plate which has waterproof straps mounted on each end for securing a camera to the plate and an elongated resilient waterproof strap fastened at one end to the plate and arranged for at least partially surrounding the arm of the user to extend through a slot in the plate and then is folded back on itself and attached to itself for firmly anchoring the plate and a camera mounted thereon to the arm of the user.

6 Claims, 7 Drawing Figures

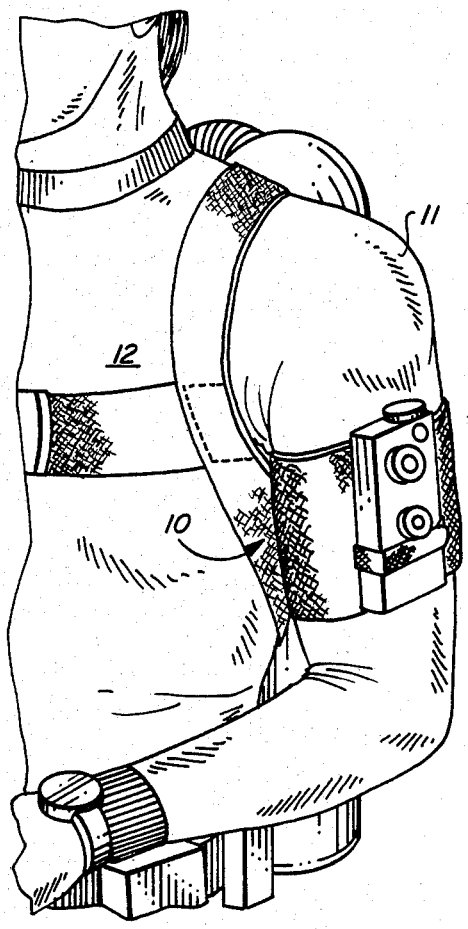
FIG-1
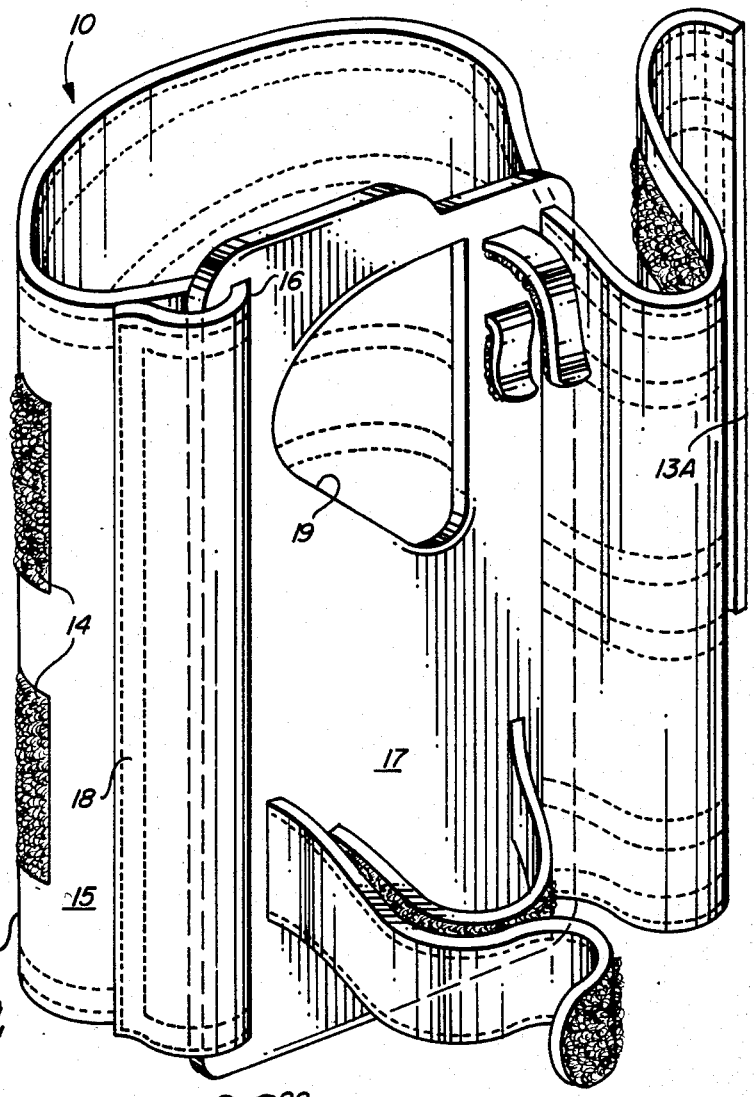
FIG-2
FIG-3
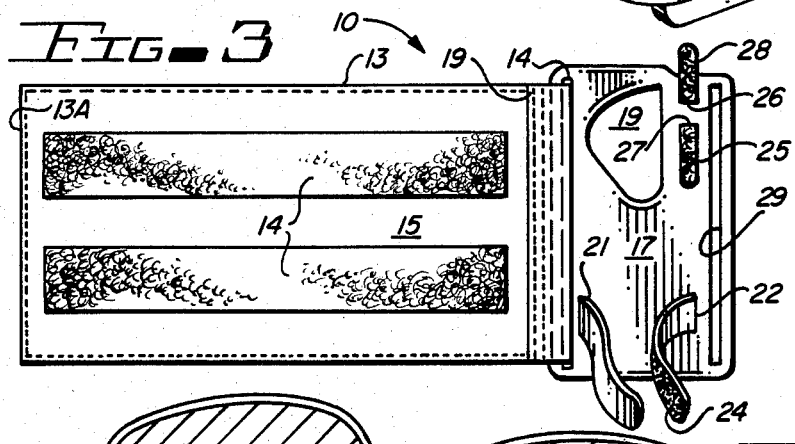
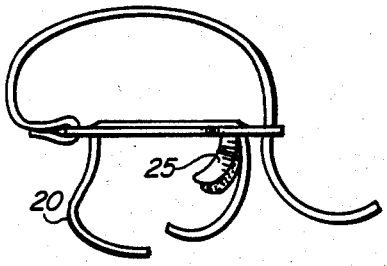
FIG-4A
FIG-4C
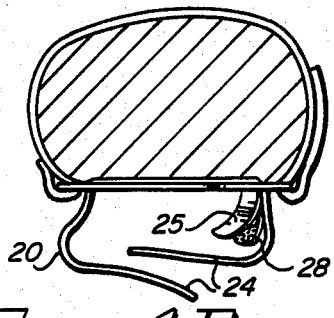
FIG-4B
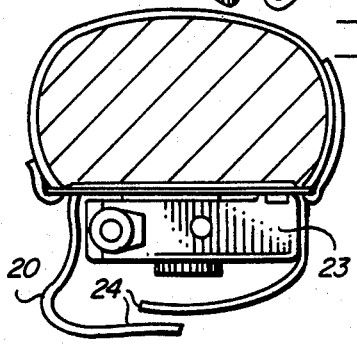
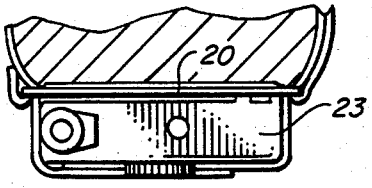
FIG-4D

WRIST OR ARMBAND FOR HOLDING CAMERA

BACKGROUND OF THE INVENTION

This invention relates to apparatus for mounting a camera on the wrist or arm of the user and particularly for users while involved in physical activity such as skiing, surfing and the like.

It is difficult to take action photographs, particularly by the party involved in the physical activity, since the camera must be available and in position for the action shot at the time the action occurs.

In addition to the problem of providing a steady rest for a camera, the camera must be operable by only one hand of the user. Most cameras are intended to be operated with the camera held mainly by the left hand while its controls are manipulated by the right hand. Obviously where a person is involved in a physical activity such as skiing and surfing, it is difficult if not impossible to hold and operate a camera during this type of physical activity.

DESCRIPTION OF THE PRIOR ART

Although the problem of firmly gripping a camera under various operating conditions has existed from the time of its development, it has only recently been used in the attempt to take action skiing and surfing photographs and no prior art is known of mounting a camera on the wrist and arm of such a user.

U.S. Pat. No. 3,966,101 discloses a camera support employing an arm engaging section which is attached to and embraces the forearm of one using the support which support projects outwardly from the arm engaging section.

U.S. Pat. No. 3,938,166 discloses a camera side strap for attachment to a typical 35 mm camera designed to firmly circle the middle, ring and little finger of the hand while leaving the index finger and thumb free for using in gripping and operating the camera.

U.S. Pat. No. 2,187,449 discloses a camera the frame of which is curved similar to the frame of a wristwatch and having straps attached thereto for securing the frame to the wrist of a person.

U.S. Pat. No. 2,771,014 discloses a camera handle which includes a grip portion adapted to be held in one's hand and an armrest adapted to engage one's arm. The camera handle has secured thereto a mounting bracketed for a camera.

U.S. Pat. No. 4,341,331 discloses a hook and loop type article for holding a key on the wrist of a bather, swimmer, skier or the like.

U.S. Pat. Nos. 4,096,863 and 4,103,808 disclose bands for anchoring a cathetor and a watchband to the hand or arm of a user.

None of these prior art patents disclose a wrist armband for holding a camera in a comfortable position for transporting and instant use and particularly for use by a person involved in a physical activity such as, for example, skiing, surfing or the like.

SUMMARY OF THE INVENTION

In accordance with the invention claimed, a new and improved article is provided which firmly anchors a camera to the wrist or arm of a user in a position for easy access and use by the wearer.

It is, therefore, one object of this invention to provide a new and improved wrist or armband which enables a camera to be firmly held and transported by one arm of a user while positioning the camera in a position for instant use by the other arm and hand of the user even during physical movement of the user.

Another object of this invention is to provide a new and improved camera support including an arm engaging portion which firmly and snugly fits the user regardless of his or her arm size.

A further object of this invention is to provide a new and improved wrist and armband for supporting a camera which is rugged, flexible and useable even in and under water.

A still further object of this invention is to provide a new and improved camera support for wearing on the wrist or arm of a user which is simple and economical to manufacture and easy to apply.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which:

FIG. 1 is a perspective view of a camera support mounted on a user and embodying the invention;

FIG. 2 is an enlarged perspective view of the camera support shown in FIG. 1;

FIG. 3 is a plan view of the camera support shown in FIGS. 1 and 2;

FIG. 4A is a top view of FIG. 2;

FIG. 4B is a view similar to FIG. 4A with the camera support surrounding the arm of a user.

FIG. 4C is a view similar to FIG. 4B surrounding the arm of a user and a camera inserted in position for securing by mounting strips; and FIG. 4D is a view similar to FIG. 4C with the mounting straps securing the camera in place.

DESCRIPTION OF THE PREFERRED EMBODIMENT

Referring more particularly to the drawing by characters of reference, FIG. 1 illustrates a camera holding support, device or apparatus 10 for surrounding the wrist, forearm or upperarm 11 of a user 12. Although FIG. 1 illustrates the apparatus on the left arm, as shown, it may be readily placed on the right arm and FIG. 2 illustrates apparatus 10 in a position for mounting on the right arm of a user.

Apparatus 10 as shown in FIG. 3 comprises an elongated flexible strap 13 of a water resistant material such as, for example, neoprene which is provided with two spaced elongated strips 14 of a Velcro fastening material arranged on one surface 15 thereof to extend along substantially two-thirds of its length. One end of strap 13 is arranged to extend through a slot 16 in a camera mounting plate 17 and is then folded back on itself and suitably secured to an area 18 on its surface 15.

Plate 17 may comprise a piece of plastic material which is provided with an aperture 19 for providing an opening for receiving the protrusion of the sequencing lever of a camera mounted on plate 17.

A strap 20 formed of a resilient waterproof plastic material such as neophrene is mounted to extend through a pair of slots 21 and 22 at one end of plate 17, as shown in FIG. 3, for surrounding one end of a camera 23, shown in FIGS. 4C and 4D to firmly hold the camera on plate 17 when the free ends of strap 20 are overlapped around the camera and a Velcro connector 24 the parts of which are secured to juxtapositioned parts of the overlapping ends are engaged in a manner well known in the art.

Plate 17 is further provided with a strap formed of a resilient waterproof material such as neophrene that extends through a pair of slots 26, 27 provided in plate 17 adjacent aperture 19 as shown in FIG. 3 which surround another portion of camera 23 at that end of plate 17. As noted, strap 25 is also provided with a Velcro connector 28 on its ends which when engaged anchor that end of the camera to the holding plate 17.

After securing camera 23 on plate 17 by straps 20 and 25 in a manner such that the lens 29 of the camera is extending outwardly of the plate, as shown in FIGS. 4C and 4D, and the longitudinal orientation of plate 17 is such that the arm of the user may be bent and moved to expose the viewing opening of the camera to the eyes of the user, strap 13 is wrapped around the arm of the user. The free end 13A of strap 13 is inserted through a slot 29 in plate 17 on the opposite side of the plate from its slot 16 and folded back on itself with the end of the Velcro connector 14 adjacent end 13A of strap 13 overlapping itself and firmly attaching thereto in the known manner.

Thus, a camera may be readily mounted on the arm of a user in a comfortable position for carrying and readily available for use without removing the camera from the arm or wrist mounted position.

Although but one embodiment of the present invention has been illustrated and described, it will be apparent to those skilled in the art that various changes and modifications may be made therein without departing from the spirit of the invention or from the scope of the appended claims.

What is claimed is:

1. An arm mountable camera support comprising:

a thin plate for supporting a camera, an elongated strap for looping at least partially around the arm of a user, said plate having a pair of slots extending longitudinally thereof one along each side thereof, and an aperture at one end thereof for receiving the camera film sequencing means therein, one end of said strap extends through one of said slots and is folded back on and secured to itself, a pair of camera holding straps one attached to each end of said plate for securing each end of a camera positioned on said plate, and at least one strip of a Velcro connector mounted on a surface of said elongated strap to extend longitudinally thereof, whereby when the other end of said elongated strap is extended through said other of said slots in said plate and folded back on itself to tightly surround an arm of a user, said Velcro connector on said elongated strap engages itself along its length to securely hold the support on the arm of the user.

2. The arm mountable camera support set forth in claim 1 wherein:

said elongated strap comprises a resilient water repellent material.

3. The arm mountable camera support set forth in claim 1 wherein:

said elongated strap comprises a neoprene material.

4. The arm mountable camera support set forth in claim 1 wherein:

said plate comprises a thin piece of rigid plastic material.

5. The arm mountable camera support set forth in claim 1 wherein:

said camera holding straps each comprise a resilient water proof material which extend through anchoring slots formed in each end of said plate for securing the camera to said plate.

6. The arm mountable camera support set forth in claim 5 wherein:

each of said camera holding straps is formed of neoprene having Velcro connecting means at their engageable ends.

* * * * *